US005831385A

United States Patent [19]

Schiabel et al.

[11] Patent Number: 5,831,385

[45] Date of Patent: Nov. 3, 1998

[54] MERCURY DISPENSING COMPOSITION CONTAINING CU-SI ALLOY PROMOTER

[75] Inventors: Antonio Schiabel, Garbagnate; Claudio Boffito, Rho, both of Italy

[73] Assignee: SAES Getters S.p.A., Milan, Italy

[21] Appl. No.: 777,785

[22] Filed: Jun. 7, 1995

[30] Foreign Application Priority Data

Jul. 7, 1994 [IT] Italy ..... MI94A1416

[51] Int. Cl.[6] ..... H01J 17/26; H01J 61/28; H01J 7/18; H01K 1/56

[52] U.S. Cl. ..... 313/550; 252/181.3

[58] Field of Search ..... 252/181.3, 181.6; 445/9, 16, 19; 313/550, 556, 558, 561

[56] References Cited

U.S. PATENT DOCUMENTS

| | | | |
|---|---|---|---|
| 3,657,589 | 4/1972 | Della Porta et al. . | |
| 3,722,976 | 3/1973 | Porta et al. . | |
| 4,464,133 | 8/1984 | Buhrer | 252/181.3 |
| 4,902,579 | 2/1990 | Grasselli et al. . | |
| 5,520,560 | 5/1996 | Shiabel et al. | 252/181.3 |

FOREIGN PATENT DOCUMENTS

| | | | |
|---|---|---|---|
| 0 091 297 | 10/1983 | European Pat. Off. . | |
| 0091297 | 10/1983 | European Pat. Off. | 7/18 |

*Primary Examiner*—William L. Oen
*Attorney, Agent, or Firm*—Hickman & Martine, LLP

[57] ABSTRACT

A mercury dispensing device is disclosed that includes a mercury dispenser having the formula $Ti_xZr_yHg_z$ in which x and y are between 0 and 13, inclusive, the quantity x+y is between 3 and 13, inclusive, and z is 1 or 2; and a promoter that comprises copper, silicon and possibly a third metal selected among the transition elements. A getter material selected among titanium, zirconium, tantalum, niobium, vanadium and mixtures thereof, and alloys of these metals with nickel, iron or aluminum can be included in the device. The mercury dispenser, promoter and optional getter material are provided preferably in the form of powders compressed as a pellet, or contained in a ring-shaped metallic support or rolled on the surfaces of a metallic strip. Also disclosed is a process for introducing mercury into electron tubes by making use of the above-mentioned mercury-dispensing devices.

6 Claims, 2 Drawing Sheets

MERCURY DISPENSING COMPOSITION CONTAINING CU-SI ALLOY PROMOTER

CLAIM OF PRIORITY PURSUANT TO 35 U.S.C. §119

This patent application claims priority under 35 U.S.C. §119 from Italian Patent Application Serial No. MI94 A 001416 filed Jul. 7, 1994.

BACKGROUND OF THE INVENTION

1. The Field of the Invention

The present invention relates to the deposition of mercury (Hg) into defined locations and to devices for such dispensing. More particularly, the present invention includes mercury-dispensing devices for the introduction of mercury into electron tubes.

2. The Relevant Art

The use of small amounts of mercury in devices such as electron tubes, for example, mercury-arc rectifiers, lasers, various kinds of alphanumeric displays and, particularly, fluorescent lamps, is well known. Providing the minimum quantity of mercury required inside these devices is extremely important to maintain the performance of these devices, and, especially, to minimize environmental impact during their construction and use. The high toxicity of mercury also poses serious ecological hazard relating to the disposal of mercury-containing devices. Such concerns have been the subject of legislative focus, and recent international regulations have sought to establish upper limits for the amount of mercury that can be used in these devices. For example, it has been suggested that fluorescent lamps include no more than 10 milligrams (mg) of mercury per lamp.

Mercury has been introduced into electron tubes in liquid form. However, the high vapor pressure of mercury at room temperature posed problems for its storage and handling. Also, introducing precise and reproducible doses of microliter quantities of liquid mercury was extremely difficult to control, and often resulted in the introduction of excess amounts of the element into the device.

The use of liquid mercury contained in capsules has also been disclosed, for example, in U.S. Pat. Nos. 4,823,047 and 4,754,193, referring to the use of metallic capsules, and in U.S. Pat. Nos. 4,182,971 and 4,278,908 wherein the mercury container is made of glass. After introducing the mercury-containing container into the electron tube, the mercury is released by means of a heat treatment which causes the container tip to break.

These methods generally have several drawbacks. First, the production of the capsules and their mounting inside the electron tubes is complex, especially where the tubes are small. Second, breaking a capsule, especially a glass capsule, can produce fragments of material that can impair the functioning of the electron tube. To address the latter problem, U.S. Pat. No. 4,335,326 discloses an assembly wherein the mercury-containing capsule is itself located inside a capsule which acts as a shield for the fragments. Third, the release of the mercury is often violent and may damage the inner structure of the tube. Finally, capsule systems still use liquid mercury, and therefore do not completely solve the problems of delivering precise and reproducible amounts of a few milligrams of mercury into a small space.

U.S. Pat. No. 4,808,136 and European Patent Application Serial No. EP-568,317 disclose the use of tablets or small spheres of porous material soaked with mercury which is released by heating once the tube is closed. However, these methods also require complicated operations to loading the mercury into the tablets, and the amount of mercury released into the tube is difficult to control reproducibly. In addition, these methods still involve liquid mercury.

The use of amalgams of mercury with, for example, indium, bismuth, or zinc, is also known. In general, however, these amalgams have the drawback of a low melting point coupled with high mercury vapor pressure at relatively low temperatures. For example, the zinc amalgams described in the commercial bulletins of APL Engineering Materials Inc., have a mercury vapor pressure at 43° C. which is about 90% of that of liquid mercury. Consequently, the amalgams do not easily withstand the thermal treatments employed in the production of the electron tubes into which the amalgams are introduced, during which treatments the mercury-dispensing devices may reach temperatures of about 400° C.

These drawbacks are overcome in U.S. Pat. No. 3,657,589, which discloses the use of intermetallic compounds of titanium (Ti), zirconium (Zr) and mercury having the general formula $Ti_xZr_yHg_z$, in which x and y may vary between 0 and 13, the sum x+y may vary between 3 and 13, and z may be 1 or 2. These compounds have mercury-release temperatures which vary according to the specific composition of the intermetallic compound. However, all of these compounds are stable up to about 500° C., both in the atmosphere and in vacuo, making them, compatible with the assembly operations for electron tubes. The mercury is released from the above-cited compounds by an activation operation, which is usually carried out by heating the material between 750° C. and 900° C. for about 30 seconds. This heating may be accomplished by laser radiation, or by induction heating of the metallic support of the mercury-dispensing compound. The use of the $Ti_3Hg$ compound (x=3, y=0 and z=1), manufactured and sold by SAES Getters S.p.A. (Milan, Italy) under the trade name St 505, has been shown to be particularly advantageous because of its availability in the form of a powder compressed in a ring-shaped container or in pills or tablets, sold under the trademark "STAHGSORB", or in the form of powders laminated on a metallic strip, sold under the trademark "GEMEDIS".

In addition to the above-described stability during the production cycle of the tubes, during which temperatures of about 350°–400° C. may be reached, the $Ti_xZr_yHg_z$ compounds can also be combined with a getter material can be easily added to the mercury-dispensing compound for the purpose of chemisorption of gases such as carbon monoxide (CO), carbon dioxide ($CO_2$), molecular oxygen ($O_2$) molecular hydrogen ($H_2$) and water ($H_2O$), which would interfere with the tube operation; the getter is activated during the same heat treatment in which the mercury is released as described in U.S. Pat. No. 3,657,589. Furthermore, the amount of mercury released by the $Ti_xZr_yHg_z$ compounds is controllable and reproducible.

Despite their good chemical and physical characteristics, and their ease of use, these materials have the drawback that the contained mercury is not completely released during the activation treatment. Furthermore, production processes for mercury-containing electron tubes include a tube closing operation performed by either glass fusion, e.g., for the sealing of fluorescent lamps, or by frit sealing, e.g., in welding two pre-shaped glass members by means of a paste of low-melting glass. During these operations, the mercury-dispensing device may undergo an indirect heating up to about 350°–400° C. In this step, the dispensing device is exposed to gases and vapors emitted by the melted glass and, in almost all industrial processes, to air. Under these conditions, the mercury-dispensing material undergoes a surface oxidation, which results in a yield (i.e., the percentage of mercury which is released) of about 40% of the total mercury content during the activation process. The mercury not released during the activation operation is then slowly released during the life of the electron tube. This characteristic, together with the fact that the tube must obviously work from the beginning of its life cycle, leads to the necessity of introducing into the device about twice as much mercury than that which would be theoretically necessary.

In order to overcome these problems, European Patent Application Serial No. EP-A-091,297 suggests the addition of nickel (Ni) or copper (Cu) powders to the $Ti_xZr_yHg_z$ compounds in which x=3, y=0 and z=1 ($Ti_3Hg$) or x=0, y=3 and z=1 ($Zr_3Hg$). According to this document, the addition of Ni or Cu to the mercury-dispensing compounds causes melting of the mercury-containing materials, favoring the release of almost all of the mercury in a few seconds. The melting takes place at the eutectic temperatures of the Ni—Ti, Ni—Zr, Cu—Ti and Cu—Zr systems, ranging from about 880° C. for the Cu 66%–Ti 34% composition to about 1280° C. for the Ni 81%–Ti 19% composition (atomic percent). However, the document erroneously gives a melting temperature of 770° C. for the Ni 4%–Ti 96% composition.

Despite the advantages disclosed in EP-A-091,297, this document acknowledges that the mercury-containing compounds disclosed therein undergo chemical changes during the tube working treatments, and thus need protection. To this end it is suggested to enclose the mercury-containing material in containers made of a steel, copper or nickel sheet which is broken during the activation by the pressure of the mercury vapor generated inside the container. This solution is not completely satisfactory, however. As described above with respect to the capsule mercury dispensers the mercury bursts out of the containers violently, possibly damaging portions of the electron tube. Also, manufacturing such containers is quite complicated, requiring the welding of small metallic parts.

Thus, it would be advantageous to provide a mercury dispenser that is capable of delivering small amounts of mercury into devices such as electron tubes reliably, controllably, reproducibly and with little or no damage to other components in the device.

SUMMARY OF THE INVENTION

The present invention provides a mercury dispensing composition and device that is effective to deliver small amounts of mercury into devices such as electron tubes. The device of the invention can deposit mercury at lower temperatures and more reliably than heretofore possible.

In one aspect, the present invention provides a mercury-dispensing composition. The composition of the invention includes a mercury dispenser having the formula $Ti_xZr_yHg_z$ in which x and y are between 0 and 13, inclusive, the quantity x+y is between 3 and 13, inclusive, and z is 1 or 2. The composition of the invention also includes a promoter comprising an alloy of copper and silicon containing an amount of copper between about 80% by weight and about 98% by weight. In one embodiment, the weight ratio of mercury dispenser to promoter is between about 20:1 and about 1:20. In another embodiment, the ratio is between about 10:1 and about 1:5. The promoter can include optionally a metal selected from the group consisting of transition elements in an amount less than about 10% of the total weight of said promoter.

In another aspect, the present invention provides a mercury-dispensing device that comprises the above-described mercury-dispensing composition. The device of the invention can further include a getter material selected from the group consisting of titanium, zirconium, tantalum, niobium, vanadium and mixtures thereof, and alloys of these metals with nickel, iron or aluminum. In one embodiment, the device includes a mercury dispenser which is $Ti_3Hg$, a promoter which is a Cu—Si alloy containing 90% Cu by weight, and a getter material which is a Zr—Al alloy having 84% Zr by weight.

In still another aspect the present invention provides a process for introducing mercury into an electron tube. According to this aspect of the invention, the above-described mercury-dispensing device is introduced into an electron tube and heated to a temperature effective to release the mercury from the device into the electron tube. In one embodiment, the temperature is between about 500° C. and about 900° C. and the heating is performed for a period of between about 10 seconds and about 60 seconds.

These and other aspects and advantages of the present invention will become more apparent when the Description below is read in conjunction with the accompanying Drawings.

DESCRIPTION OF SPECIFIC EMBODIMENTS

Figure 1:
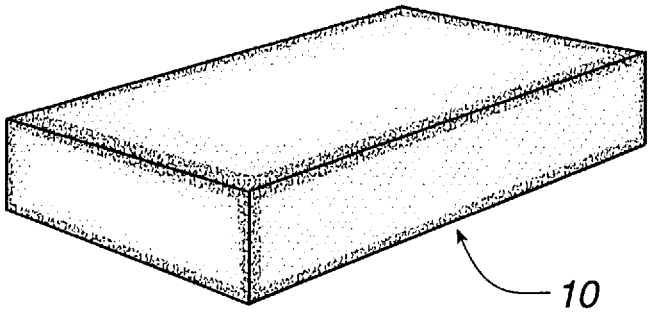
FIG. 1 is a perspective view of a mercury-dispensing device according to a possible embodiment of the present invention.

In one aspect, the present invention provides a mercury dispensing composition for depositing controlled amounts of mercury. The mercury dispensing composition is a binary composition of a first material, hereinafter referred to as the "mercury dispenser", and a second material, hereinafter is referred to as a "promoter". The mercury dispenser is an intermetallic compound of the formula $Ti_xZr_yHg_z$ in which x and y are between 0 and 13, inclusive, the quantity x+y is between 3 and 13, inclusive and z is 1 or 2, as disclosed in U.S. Pat. No. 3,657,589, incorporated herein by reference. Preferred mercury dispensing materials include those wherein x=0, y=3 and z=1 ($Zr_3Hg$) and x=3, y=0 and z=1 ($Ti_3Hg$).

The promoter functions to enhance the release of mercury from mercury dispenser. The promoter is an alloy or an intermetallic compound including copper (Cu), silicon (Si), and possibly a third metal selected from among the transition elements (i.e., those elements having atomic numbers 21–29, inclusive; 39–47, inclusive; and 57–79, inclusive). The weight ratio between copper and silicon can vary widely. In one embodiment, the present invention includes Cu—Si compositions wherein copper is present from about 80% to about 98% by weight. In another embodiment, the promoter includes Cu—Si compositions in which the weight percentage of copper is between about 84% to about 92% by weight. In still another embodiment, the present invention includes promoters comprised of alloys of three or more metals by replacing up to 10% of a Cu—Si promoter with an element selected from the transition metals.

The weight ratio between the mercury dispenser and promoter components of the binary composition of the invention may vary within a wide range. In one embodiment, the ratio of mercury dispenser:promoter is between about 20:1 and about 1:20. In another embodiment, the ratio is between about 10:1 and about 1:5. The components of the composition of the invention can be employed in various physical forms, not necessarily the same for the two components. For example, the promoter may be present in the form of a coating on a metallic support and the mercury dispenser as a powder adhered to promoter, e.g., by rolling. In one embodiment, both components are provided as a powder having a particle size smaller than about 250 μm, and, preferably, between about 10 μm and about 125 μm.

Some types of electron tubes, such as fluorescent lamps, further require the presence of a getter material to remove traces of gases such as CO, $CO_2$, $H_2$, $O_2$ or water vapor. For these applications, the getter can be conveniently introduced into the electron tube by means of the mercury-dispensing device of the present invention as described U.S. Pat. No. 3,657,589, which is incorporated by reference above. Examples of getter materials include metals such as titanium, zirconium, tantalum (Ta), niobium (Nb), vanadium (V) and mixtures thereof, or alloys thereof with other metals such as nickel, iron (Fe), aluminum (Al), such as the alloy having a weight percentage composition Zr 84%–Al 16%, sold by SAES Getters S.p.A. (Milan, Italy) under the tradename St 101, or the intermetallic compounds $Zr_2Fe$ and $Zr_2Ni$, manufactured by SAES Getters S.p.A. (Milan, Italy) under the names St 198 and St 199, respectively.

The getter can be provided in various physical forms. In one embodiment, the getter is provided as a fine powder, having a particle size smaller than about 250 μm and preferably between about 10 μm and about 125 μm. In one embodiment, the ratio between the overall weight of the binary compositions and weight of the getter material is between about 10:1 to about 1:10, preferably between about 5:1 and about 1:2. The getter material is activated during the same heat treatment by which the mercury is released inside the tube.

In a second aspect, the present invention provides mercury-dispensing devices which use the above-described binary composition. It will be appreciated that one of the advantages of the present invention is the obviation of mechanical protection for the mercury dispenser to isolate the dispenser from the environment. Thus, the present invention does not suffer from the limitations of a dosed container. Consequently, the mercury-dispensing devices of the present invention can be manufactured in various geometric shapes, and components of the above-described binary combination can be employed with or without support. In embodiments including a support, the support is generally metallic. Some possible embodiments of the devices of the invention are illustrated below with reference to accompanying Drawings. It will be appreciated that the embodiments exemplified below can be formed using known methods and materials.

In one embodiment, shown in FIG. 1, a mercury-dispensing device of the invention includes a pellet 10 comprising compressed and unsupported powders including the mercury dispenser and promoter. In one embodiment the device has a cylindrical or parallelepiped shape, as shown in FIG. 1. It will be appreciated that such configurations are easily produced. Optionally, a getter material can be included in the pellet in addition to the mercury dispenser and promoter.

Figure 2:
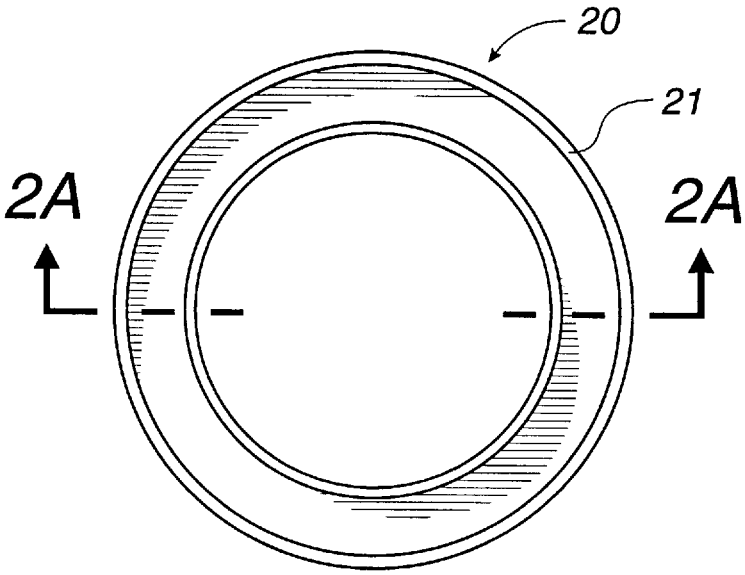
FIG. 2 and FIG. 2A are, respectively, a top plan view and a sectional view along line 2A—2A of a device of the invention according to another possible embodiment of the present invention.
Figure 2A:
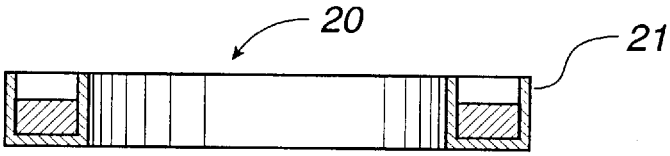

In another embodiment, shown in FIGS. 2 and 2A, the materials are supported, e.g., by a ring 20. FIG. 2 illustrates a top view of the device. FIG. 2A illustrates a cross-section of the device along line 2A—2A of FIG. 2. As shown in FIG. 2A, the device comprises a support 21 having the shape of a torroidal channel which contains the mercury dispenser, promoter, and, optionally, getter materials. In one embodiment, the support is formed of metal, preferably nickel-plated steel.

Figure 3:
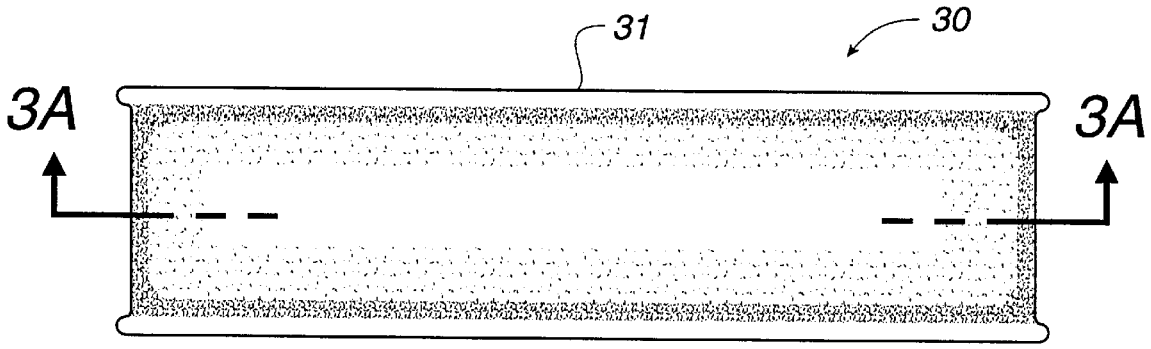
FIG. 3, FIG. 3A and FIG. 3B are, respectively, a top plan view and two sectional views along 3—3 of a device of the invention according to a further embodiment, in two possible variations.
Figure 3A:
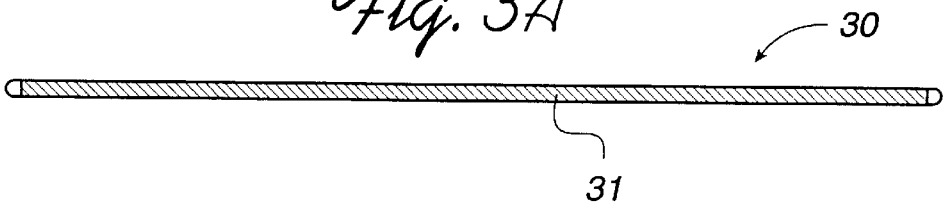
Figure 3B:
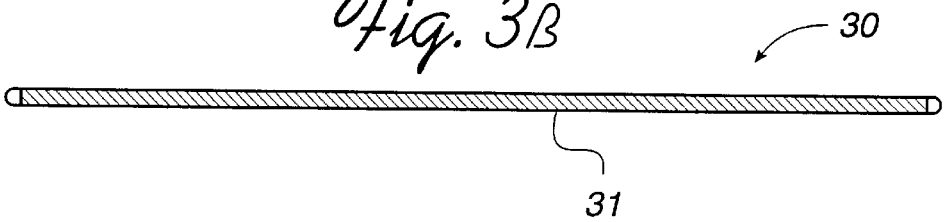

In still another embodiment, shown in FIGS. 3, 3A and 3B, the device comprises a strip 30. FIG. 3 illustrates a top view of the device. FIG. 3A and 3B illustrate a cross-section along line III—III of FIG. 3 for two different embodiments. The device comprises a support 31 of a metal strip, preferably made of nickel-plated steel, onto which the mercury dispenser, promoter and, optionally, getter materials are deposited, e.g., by cold compression (rolling). In one embodiment, shown in FIG. 3A, a getter material is included with the mercury dispenser and promoter. The materials are mixed together and rolled on one or both faces of the strip. A second embodiment is shown in FIG. 3B, in which the mercury dispenser and promoter are deposited on one surface of the strip and the getter material is deposited on the opposing surface.

In still another aspect, the present invention provides a method for introducing mercury into a volume, e.g., an electron tube, using the above-described devices. According to the method of the invention, an above-described mercury-dispensing device, e.g., one of the above-described devices 10, 20 or 30 of FIGS. 1–3 respectively, is introduced into the volume and heated to a temperature effective to release the mercury from the device. The heating can be performed using any suitable heating means such as radiation, high-frequency induction heating or resistive heating (e.g., by flowing a current through a support comprising a material having high electric resistivity). The release of mercury is effected by heating the mercury dispensing device to a temperature between about 500° C. and about 900° C. for a period between about 10 seconds and about 60 seconds. At temperatures lower than 500° C. almost no mercury is dispensed at all; whereas at temperatures greater than 900° C. there is the danger of producing noxious gases from the portions of the electron tube adjacent the device due to outgassing, or the formation of metal vapors.

EXAMPLES

The following examples describe specific aspects of the invention to illustrate the invention and aid those of skill in the art in understanding and practicing the invention. However, these examples should not be construed as limiting the invention in any manner.

Examples 1 and 2 concern the preparation of the mercury dispenser and promoter of the invention. Examples 3–6 describe the results of tests for mercury release after a heat treatment which simulates the electron tube sealing operation. All the metals used for the preparation of alloys and compounds for the following tests have a minimum pureness of 99.5% and are available commercially. All percentages are on a weight basis unless otherwise specified.

EXAMPLE 1

This example illustrates the synthesis of the mercury-dispensing material $Ti_3Hg$.

143.7 g of titanium powder was placed in a steel crucible and degassed by furnace treatment at a temperature of about 700° C. and a pressure of $10^{-6}$ mbar for about 30 minutes. After cooling the titanium powder in an inert atmosphere, 200.6 grams (g) of mercury was introduced into the crucible by means of a quartz tube. The crucible was closed and heated at a temperature of about 750° C. for about 3 hours. After cooling, the product was ground until a powder capable of passing through a 120 $\mu$m-sized mesh standard sieve was obtained. The resulting material consisted essentially of $Ti_3Hg$, as confirmed by standard diffractometric methods.

EXAMPLE 2

This example concerns the preparation of a copper-silicon promoter of 90% copper.

4.5 g of silicon (pureness 99.99%) and 40.2 g of copper (pureness 99.9%), both in powder form, were placed into an alumina crucible which was placed into a vacuum induction furnace. The mixture was heated at a temperature of about 900° C. for about 5 minutes to ensure homogeneous heating, and finally cast into a steel ingot mold. The ingot was ground in a blade mill and the resulting powder was sieved as in Example 1.

EXAMPLES 3–6

Examples 3–6 describe tests for the release of mercury from mixtures consisting of combinations of a mercury-dispenser A and a promoter B after a heat treatment in air which simulates the conditions to which the device of the invention would subjected during the sealing of an electron tube. For the simulation of the sealing, 150 g of each mixture was loaded into a ring-shaped container as shown in FIG. 2 and subjected to the following thermal cycle in air:

1. heating from room temperature to 450° C. in about 5 seconds;
2. isotherm at 450° C. for 60 seconds;
3. cooling from 450° C. to 350° C., in about 2 seconds;
4. isotherm at 350° C. for 30 seconds; and
5. spontaneous cooling to room temperature, requiring about 2 minutes.

The mercury release tests were carried out on the treated samples by heating the sample using an induction heater at a temperature of about 850° C. for about 30 seconds inside a vacuum chamber followed by measuring the mercury remaining in the dispensing device using the complexometric titration method according to Volhard.[1]

[1]Wilson, C. L., and D. W. Wilson. 1962. *Comprehensive Analytical Chemistry.* Elsevier.

The results of the tests are summarized in Table 1, which shows the mercury-dispensing component A, the promoting material B prepared as in Example 2, the weight ratio between components A and B, and the mercury yield (the percentage of mercury released during the test).

TABLE 1

| Example | A | B | A/B | Yield Hg (%) |
|---|---|---|---|---|
| 3* | $Ti_3Hg$ | — | — | 35.2 |
| 4* | $Ti_3Hg$ | Cu | 5/1 | 45.7 |
| 5* | $Ti_3Hg$ | Si | 4/1 | 24.3 |
| 6* | $Ti_3Hg$ | Cu—Si | 7/3 | 99.2 |

As seen from the results reported in Table 1, combinations using the promoter of the invention produced mercury yields higher than 99% during the activation step. It will be appreciated that this result indicates that a reduction of the overall mercury amount introduced in the electron tubes can be achieved using the mercury dispensers of the invention.

Furthermore, combinations using the promoter of the present invention allow for the performing the above-described activation operation at lower temperatures, or with shorter heating times, than allowed by current materials. For example, $Ti_3Hg$ requires an activation temperature of about 900° C. for industrially acceptable activation times. Present combinations allow a reduction of this temperature to about 850° C. for the same time, or, alternatively, at the same temperature with reduced operation time and reduced production lines. In either case, the double advantage of less pollution inside the tube, due to the outgassing of all the materials present therein, and of reducing the amount of energy required for activation is achieved.

Although certain embodiments and examples have been used to describe the present invention, it will be apparent to those having skill in the art that various changes can be made to those embodiment and/or examples without departing from the scope or spirit of the present invention. For example, it will be appreciated from the foregoing that the mercury dispensing devices of the invention can include a mercury dispenser, a promoter and an optional getter material. In addition, these materials can be deposited in a variety of shapes to accommodate a wide variety of applications. Still more variations will be apparent to those having skill in the art.

The following materials are incorporated herein by reference in their entirety for all purposes.

What is claimed:

1. A mercury-dispensing composition comprising:

a) a mercury-dispenser having the formula $Ti_xZr_yHg_z$ wherein i) x and y are between 0 and 13, inclusive, ii) the quantity x+y is between 3 and 13, inclusive, and iii) z is 1 or 2; and b) a promoter comprising an alloy of Cu and Si having an amount of Cu between about 80% by weight and about 98% by weight.

2. The mercury-dispensing composition of claim 1, wherein the amount of Cu in said promoter is between about 84% by weight and about 92% by weight.

3. The mercury-dispensing composition of claim 1, wherein said promoter further includes a metal selected from the group consisting of transition elements in an amount less than about 10% by the total weight of said promoter.

4. The mercury-dispensing composition of claim 1, wherein the weight ratio of mercury dispenser:promoter is between about 20:1 and about 1:20.

5. The mercury-dispensing composition of claim 4, wherein said ratio is between about 10:1 and about 1:5.

6. The mercury-dispensing composition of claim 1 wherein x=3, y=0 and z=1.

* * * * *

UNITED STATES PATENT AND TRADEMARK OFFICE

CERTIFICATE OF CORRECTION

PATENT NO. : 5,831,385
DATED : November 3, 1998
INVENTOR(S) : Schiabel et al.

It is certified that error appears in the above-identified patent and that said Letters Patent is hereby corrected as shown below:

Abstract, line 1, change "mercury dispensing" to --mercury-dispensing--

Column 1, line 8, after "Jul. 7, 1994" add --which is incorporated herein by reference--

Signed and Sealed this

Twenty-fifth Day of April, 2000

*Attest:*

Q. TODD DICKINSON

*Attesting Officer*

*Director of Patents and Trademarks*